US008031081B2

(12) United States Patent
Pisoni et al.

(10) Patent No.: US 8,031,081 B2
(45) Date of Patent: Oct. 4, 2011

(54) WIRELESS TELEMETRY BETWEEN WELLBORE TOOLS

(75) Inventors: Attilio C. Pisoni, Dubai (AE); David L. Smith, Lafayette, LA (US); Brian Clark, Sugar Land, TX (US); Jean Seydoux, Sugar Land, TX (US); Vassilis Varveropoulos, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1133 days.

(21) Appl. No.: 11/769,098

(22) Filed: Jun. 27, 2007

(65) Prior Publication Data

US 2008/0158006 A1 Jul. 3, 2008

Related U.S. Application Data

(60) Provisional application No. 60/882,358, filed on Dec. 28, 2006.

(51) Int. Cl.
*G01V 3/00* (2006.01)

(52) U.S. Cl. ..... 340/854.8; 340/854.4; 340/853.6; 324/339; 175/40; 175/50

(58) Field of Classification Search ..... 340/853.6, 340/855.5, 854.4, 854.8; 324/339; 175/50, 175/40

See application file for complete search history.

(56) References Cited

U.S. PATENT DOCUMENTS

| | | | |
|---|---|---|---|
| 5,721,538 | A | 2/1998 | Tubel et al. |
| 6,188,222 | B1 | 2/2001 | Anadrill |
| 6,462,672 | B1 | 10/2002 | Schlumberger |
| 6,577,244 | B1 | 6/2003 | Clark et al. |
| 6,836,218 | B2 | 12/2004 | Frey et al. |
| 6,885,308 | B2 | 4/2005 | Smith et al. |
| 6,903,660 | B2 | 6/2005 | Clark et al. |
| 6,975,243 | B2 | 12/2005 | Clark et al. |
| 6,995,684 | B2 | 2/2006 | Clark |
| 2003/0141872 | A1 | 7/2003 | Clark et al. |
| 2003/0142586 | A1 | 7/2003 | Halliburton |
| 2004/0231851 | A1 | 11/2004 | Silversmith |
| 2005/0107079 | A1 | 5/2005 | Schultz et al. |
| 2005/0279532 | A1 | 12/2005 | Ballantyne et al. |
| 2006/0254819 | A1 | 11/2006 | Moriarty |

*Primary Examiner* — Albert Wong
(74) *Attorney, Agent, or Firm* — John Vereb; Jeremy Welch

(57) ABSTRACT

An embodiment of a wireless telemetry system for providing signal communication across a wired-communication gap in a bottom-hole assembly ("BHA"), the BHA having an upper portion and a lower portion separated by the wired-communication gap, includes an upper transceiver positioned in the upper portion and in signal communication with a surface telemetry system and a lower transceiver positioned in the lower portion and in signal communication with a drilling tool, the upper and the lower transceivers in signal communication with one another via wireless induction telemetry. Each transceiver may include an antenna that is positioned within the bore of a drill collar adjacent to a thinned wall section in the drill collar. The thinned wall section may include one or more of increasing an inside diameter relative to a base inside diameter of the bore and decreasing an outside diameter relative to a base outside diameter of the drill collar.

11 Claims, 2 Drawing Sheets

WIRELESS TELEMETRY BETWEEN WELLBORE TOOLS

CROSS-REFERENCES

The present application claims priority of U.S. Provisional Patent Application Ser. No. 60/882,358 filed on Dec. 28, 2006. The Provisional Application is incorporated by reference in its entirety.

FIELD OF THE INVENTION

The present invention relates in general to wellbore drilling operations and more particularly to systems and methods for wireless communication between downhole drilling tools.

BACKGROUND

In order to precisely position a wellbore a driller must have accurate and real-time information regarding the position and movement of the drilling assembly, information regarding the subterranean formations and the ability to control the drilling assembly. To accomplish these goals bottom-hole assemblies ("BHA") commonly include various combinations of measurement while drilling ("MWD") and logging while drilling ("LWD") techniques and systems. In general, MWD systems collect data such as dip and inclination of the drilling assembly and LWD systems collect data associated with formation characteristics for formation evaluation. For convenience, an instrument combination that includes LWD and MWD systems will be referred to hereinafter as MWD systems. Bottom-hole assemblies also commonly include drilling tools such as a steering system.

The MWD system and/or steering system are typically wired to a surface telemetry system for transmitting signals containing data obtained downhole to the surface and for receiving command signals from the surface. A typical surface telemetry system utilizes mud-pulse telemetry. In this method, a modulator consisting of a rotary valve operates on a continuous pressure wave in the mud column. By changing the phase of the signal (frequency modulation) and detecting these changes, a signal can be transmitted between the surface and the downhole tools. Often modulators and receivers are position at the surface, for example in the mud pump discharge line, and in the BHA so the data and commands can be transmitted between the surface and the BHA.

It has been realized that there are situations in which the complete span of the BHA cannot be wired to transmit data via wiring to the surface telemetry system. This typically occurs when one or more of the BHA sections cannot be practically or feasibly through-wired. One common example of a wired-communication gap in the BHA is in rotary steerable drilling systems. In these systems a mud motor is included in the BHA. The mud motor typically cannot feasibly provide through-wiring to transmit data between the surface telemetry system and the drilling tool that provides inclination data and/or steering control. One solution is to position the various sensors and tools above the mud motor for connection with the surface telemetry system. However, this configuration does not provide the data necessary for precise well placement. Other tools such as, without limitation, reamers, filters, stabilizers, and drill collars also create wired-communications gaps in the BHA. These wired-communication gaps severely limit BHA configuration options and the ability to precisely control and position and wellbore.

Therefore, it is a desire to provide a wireless telemetry system that addresses drawbacks of the prior art MWD systems. It is a still further desire to provide a wireless telemetry system for communicating between wellbore tools and systems. It is a still further desire to provide a wireless telemetry system that bridges wired-communication gaps in a BHA.

SUMMARY OF THE INVENTION

Accordingly, wireless telemetry systems and methods are provided for bridging gaps in wired communication between tools or systems positioned in a wellbore are provided. In one embodiment, a wireless telemetry system for providing communication between at least two wellbore tools includes a first transceiver in signal communication with a first wellbore tool and a second transceiver in signal communication with a second wellbore tool, the first and the second transceiver in signal communication with one another via wireless induction telemetry.

An embodiment of a wireless telemetry system for providing signal communication across a wired-communication gap in a bottom-hole assembly ("BHA"), the BHA having an upper portion and a lower portion separated by the wired-communication gap, includes an upper transceiver positioned in the upper portion and in signal communication with a surface telemetry system and a lower transceiver positioned in the lower portion and in signal communication with a drilling tool, the upper and the lower transceivers in signal communication with one another via wireless induction telemetry.

An embodiment of a method of bridging a wired-communication gap in a bottom-hole assembly that separates an upper portion including a surface telemetry system and a bottom portion having a drilling tool, the method includes the steps of providing an upper transceiver in signal communication with a surface telemetry system; providing a lower transceiver in signal communication with the drilling tool; and communicating between the upper transceiver and the lower transceiver via wireless induction telemetry.

In some embodiments the transceiver may include an antenna that is positioned within the bore of a drill collar adjacent to a thinned wall section in the drill collar. The thinned wall section may include one or more of increasing an inside diameter relative to a base inside diameter of the bore and decreasing an outside diameter relative to a base outside diameter of the drill collar.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
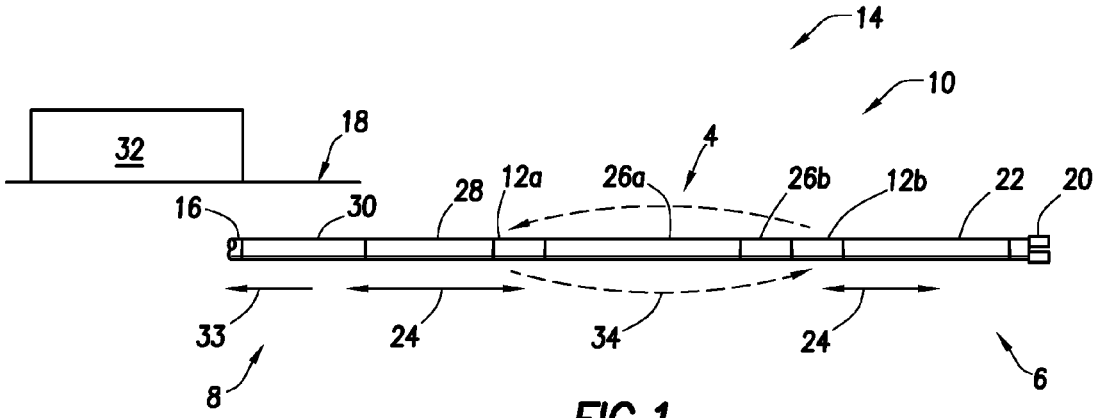
FIG. 1 is a schematic of an embodiment of a wellbore tool wireless telemetry system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic of a wellbore tool wireless telemetry system of the present invention, generally denoted by the numeral 10. Wireless telemetry system 10 includes a first and second communication link 12*a* and 12*b* in signal communication with one another. Each communication link or transceiver includes an antenna for sending and receiving a signal, associated electronics and circuitry, and power. Transceivers 12 may use induction telemetry at frequencies ranging from 500 Hz to 10 KHz.

Each transceiver 12 is in signal communication with a wellbore tool for receiving and/or transmitting data therebetween. Examples of wellbore tools include, without limitation, wellbore measurement devices, formation characteristic measurement systems, steerable systems, and surface telemetry systems for communication with the surface.

Transceivers 12 are connected within a bottom-hole assembly ("BHA") 14. BHA 14 is connected via a drilling string 16 to the surface 18. BHA 14 may include various tools and measurement devices and subs depending on the particular drilling operation. Measurement devices may include, without limitation, antennas, sources, sensors, detectors and the like for obtaining data related to formation characteristics, wellbore conditions (e.g., pressure, temperature) and positioning (e.g., dip, inclination).

BHA 14 as shown in FIG. 1 provides a general configuration of a common bottom-hole assembly. BHA 14 includes a lower portion 6 and an upper portion 8 separated by a non-through-wired section 4 creating a wired-communication gap. Lower portion 6 includes a drill bit 20 connected to a rotary steering tool 22 and system. Drilling steering tool 22, as is well known in the art, obtains positioning data such as dip and inclination and provides operational control of drill bit 20. Steering tool 22 is in wired connection, illustrated by arrow 24, with second, or bottom, transceiver 12*b* for communicating signals carrying data to and from transceiver 12*b*. Data may include dip and inclination information to be transmitted to surface 18 or may be steering commands being transmitted from surface 18 to steering tool 22.

Connected within BHA 14 above transceiver 12*b* are one or more devices that do not provide through-wire connections, generally denoted by the numeral 26. Non-through-wire devices 26 may include without limitations, mud motors, filters, flex collars, drill collars, and reamers. BHA 14 of FIG. 1 includes a mud motor 26*a* and a filter 26*b*.

Upper portion 8 of includes a formation evaluation tool 28 such as an electromagnetic resistivity tool for obtaining data associated with the surrounding formation characteristics. Tool 28 is hard-wired (arrow 24) to surface telemetry system 30. Transceiver 12*a* is in communication connection with a surface telemetry system 30 via wiring (arrow 24). Surface telemetry system 30 may be incorporated in evaluation tool 28. Surface telemetry system 30 is illustrated as a mud-pulse telemetry system for transmitting data to and receiving data from surface controller 32, arrow 33. However, it should be recognized that surface telemetry system 32 may include other means of communicating with the surface including hard-wiring or transmission of signals through the surrounding formation.

Operation of wireless telemetry system 10 is described with reference to FIG. 1. BHA 14 is includes lower portion 6 and upper portion 8 separated by a wired-communication gap. Lower portion 6 includes at least one drilling tool, illustrated as a steering system 22, in signal communication, arrow 24, with a lower or second transceiver 12*b* for communicating signals therebetween. Upper portion 8 includes at least upper or first transceiver 12*a* in signal communication with surface telemetry system 30 via wired link 24. First and second transceivers 12*a*, 12*b* are in wireless communication with one another illustrated by arrow 34.

Figure 2:
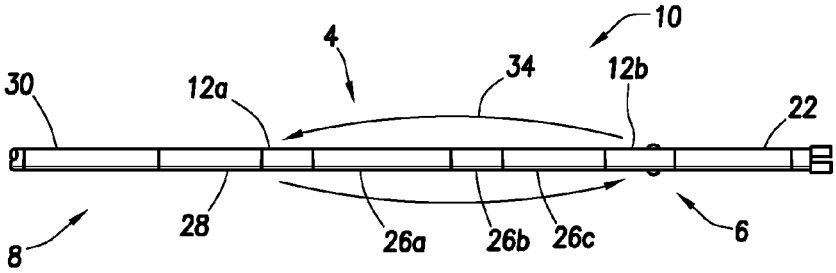
FIG. 2 is a schematic of an embodiment of a wellbore tool wireless telemetry system using a transceiver as a repeater.

Refer now to FIG. 2 wherein another example of wellbore tool wireless telemetry system 10 is illustrated. System 10 of FIG. 2 illustrates transceiver 12*b* serving as a repeater. In this illustration, drilling tool 22 includes a shorthop transmitter broadcasting the dip and inclination data on a periodic interval. Since drilling tool 22 does not have the range to communicate across non-through-wired section 4, lower transceiver 12*b* acts as a repeater to communicate the data from tool 22 to upper transceiver 12*a*. In this illustration, non-through-wired section 4 includes mud motor 26*a*, filter 24*b*, and a flex collar 26*c*.

Figure 3:
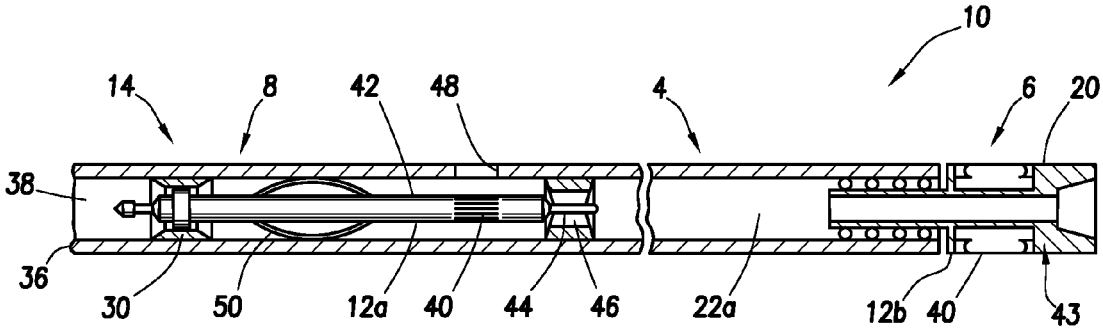
FIG. 3 is a cross-sectional view of a wellbore tool wireless telemetry system of the present invention.

FIG. 3 is a cross-sectional view of a wellbore tool wireless telemetry system 10. BHA 14 includes lower portion 6 and upper section 8 separated by a non-through-wired section 4. Lower portion 6 includes bit 20 and lower transceiver 12*b*. Lower transceiver 12*b* includes antenna 40, an integrated power source and an inclinometer 43. Inclinometer 43 may be included as part of a comprehensive drilling tool or steering system or may be a stand-alone sensor. Transceiver 12*b* communicates data from inclinometer 43 to upper transceiver 12*a*. It should be recognized that lower portion 6 may include other measurement or controllable tools not illustrated in this Figure.

Transceiver 12*b* is illustrated with antenna 40 located in the wall of drill collar 36. Mounting antenna 40 on the drill collar minimizes the collar effect on the antenna impedance. Additionally, a collar antenna 40 facilitates use of a larger antenna area thereby increasing the antenna moment and a stronger signal when transmitting. A higher carrier frequency can also be used with collar mounted antenna leading to higher bit rates. Overall, collar mounted antenna may increase the transmission distance over mandrel-type transceiver antennas.

Non-through-wired section 4 is illustrated as a mud motor 22*a*. As has been briefly described, for purposes of practicality and reliability motor 22*a* does not provide through wiring for connecting the systems of lower portion 6 and upper portion 8.

As illustrated in FIG. 3, upper transceiver 12*a* is illustrated as a mandrel-type tool disposed within the bore 38 of drill collar 36. One or more centralizers 50 are provided to restrict axial movement of transceiver tool 12*a* relative to drill collar 36 and to dampen the shocks of movement. Transceiver 12*a* is in signal communication with surface telemetry system 30 illustrated as a mud-pulse modulator. The antenna 40 is in operational connection with the associated electronics and circuitry 42 which may be enclosed in a pressure housing. Transceiver 12*a* may further include a stinger 44 adapted for connecting with landing shoe 46. In the embodiment illustrated in FIG. 3, slots 48 are formed through drill collar 36 to minimize the collar effect on the signal transmitted to and from antenna 40. Landing shoe 46 and transceiver 12*a* are spaced-out such that when transceiver 12*a* is landed, antenna 40 is positioned adjacent slots 48. As should be recognized, and illustrated in other Figures, transceiver 12*a* may be in wired or wireless signal communication with a formation evaluation measurement tool and/or disposed within a formation evaluation measurement tool.

System 10 illustrated in FIG. 3 includes a first mandrel-type transceiver 12*a* and a drill collar mounted second transceiver 12*b*. It should be recognized that both transceivers may be collar mounted or mandrel-type transceivers.

Figure 4A:
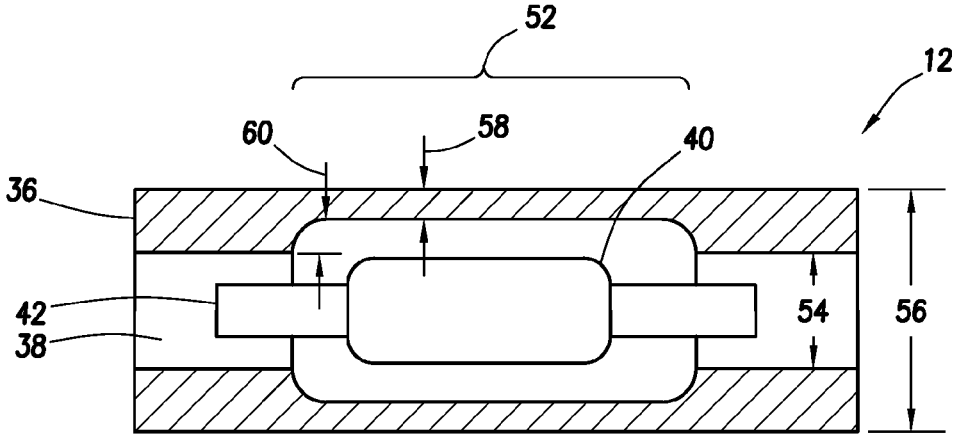
FIGS. 4A and 4B are schematic illustrations of embodiments of a mandrel-type transceivers installations of the present invention.

FIG. 4A is a schematic of a mandrel-type embodiment of a wireless transceiver 12 of the present invention. Transceiver 12 includes an antenna 40 connected to the electronics and circuitry section 42. Transceiver 12 is disposed in bore 38 of drill collar 36 with antenna 40 position proximate to a transceiver section 52 of drill collar 36. Transceiver 12 may be positioned in drill collar 36 as described with reference to FIG. 3.

Electronics and circuitry section 42 includes the signal processing, power and communication electronics disposed within a pressure housing. Transceivers 12 may be powered from the tool bus or include a dedicated battery. Transceivers 12 may include a variable rate data (BPSK or OPSK) modem with all-digital implementation of the demodulation process. The telemetry is induction type to provide mud independence. However, the telemetry may be formation resistivity dependent, thus resistivities below 0.2 Ohm-m will severely attenuate the signal (arrow 34 of FIGS. 1 and 2) at the maximum range. The carrier frequency of the described embodiments is between 500 Hz and 10 KHz with a bit rate adjustable up to 400 bps. It is believed that a carrier frequency of approximately 600 Hz may be optimal for an internal antenna, since the collar effect on the antenna impedance and the signal attenuation is at the least while allowing for 100 bps transmission speed. To adapt to varying formation resistivity and downhole noise, the bit rate may be dynamically adjusted downhole by the two transceivers. This is achieved by exchanging SNR information for each message and adjusting the bit rate of the next message so that the SNR is within acceptable limits. For an external antenna, 2 KHz may be optimal.

Drill collar 36 has a base inside diameter 54 and a base outside diameter 56. Transceiver section 52 comprises a thinned or reduced wall thickness section 58 to reduce the collar effect on the transmitted signal. In the embodiment of FIG. 4A, thinned wall section 58 is formed by increasing the inside diameter 54 of transceiver section 52 relative to the base inside diameter indicated at 60. This facilitates utilizing the maximum outside diameter antenna 40 possible for the drill collar size.

Figure 4B:
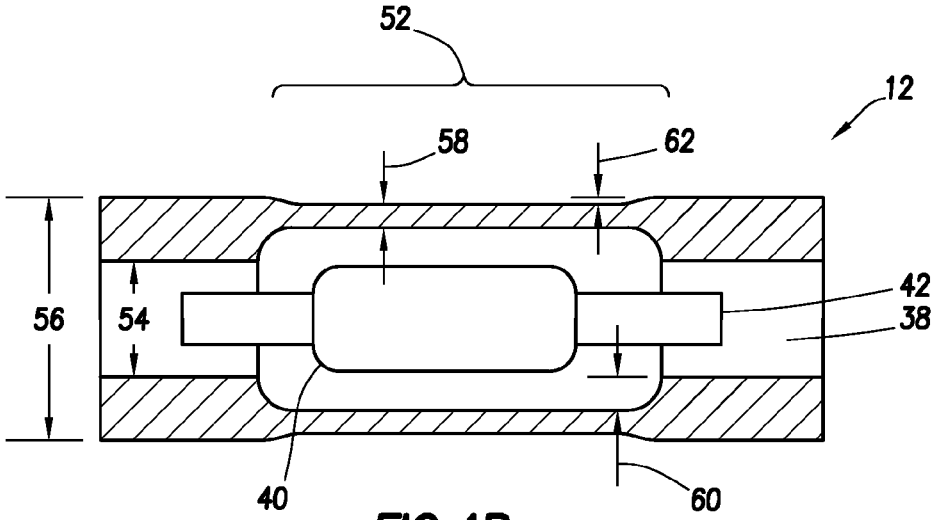

In FIG. 4B, an embodiment of thinned wall section 58 is illustrated. In this embodiment, the base outside diameter 56 is decreased along transceiver section 52 as shown at 62. Reducing the outside diameter 62 of section 52 recesses the thinned wall portion from contact with the wall of the wellbore.

Figure 5:
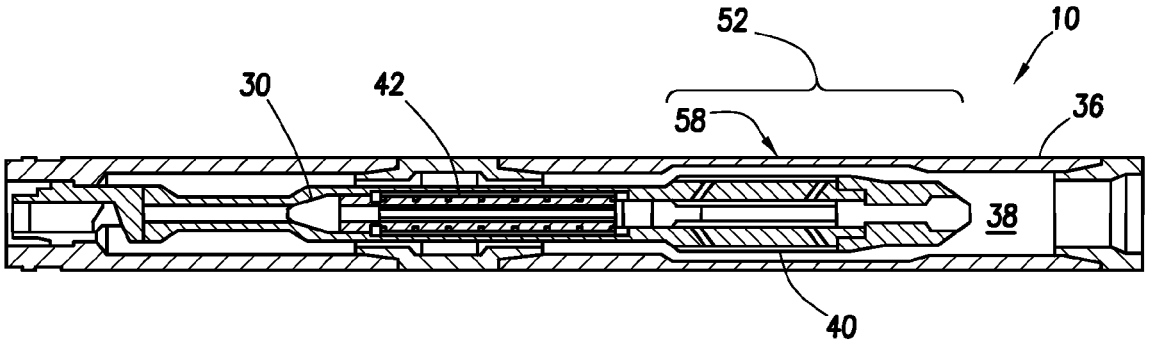
FIG. 5 is a cross-sectional view of an embodiment of a wireless transceiver of the present invention.

FIG. 5 is a cross-sectional view of a transceiver 12 of the present invention. Transceiver 12 is a mandrel-type tool positioned in bore 38 of drill collar 36. Antenna 40 is positioned adjacent to transceiver section 52. Thinned wall portion 58 has an increased inside diameter section as illustrated in FIG. 4A. Antenna 40 is connected to electronics and circuitry 42. This transceiver 12 is in wired connection with surface telemetry 30.

From the foregoing detailed description of specific embodiments of the invention, it should be apparent that a system for bridging communication gaps in bottom-hole assemblies that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A wireless telemetry system for providing communication between at least two wellbore tools, the system comprising:

a first transceiver in signal communication with a first wellbore tool; and a second transceiver in signal communication with a second wellbore tool, the first and the second transceiver in signal communication with one another via wireless induction telemetry wherein the first transceiver includes an antenna positioned within a bore of a drill collar adjacent to a thinned wall section of the drill collar, wherein the thinned wall section of the drill collar comprises one of an increased inside diameter relative to a base inside diameter of the drill collar and a decreased outside diameter relative to a base outside diameter of the drill collar.

2. The system of claim 1, wherein the first wellbore tool is a surface telemetry system.

3. The system of claim 2, wherein the surface telemetry system is a mud-pulse system.

4. The system of claim 1, wherein the first transceiver includes an antenna, the antenna being disposed within a wall of a drill collar.

5. The system of claim 1, wherein the first transceiver includes an antenna positioned within a bore of a drill collar.

6. The system of claim 1, wherein the first transceiver includes an antenna positioned within a wall of the first wellbore tool and the second transceiver includes an antenna disposed within a wall of the second wellbore tool.

7. A wireless telemetry system for providing signal communication across a wired-communication gap in a bottom-hole assembly ("BHA"), the BHA having an upper portion and a lower portion separated by the wired-communication gap, the system comprising:

an upper transceiver positioned in the upper portion and in signal communication with a surface telemetry system; and a lower transceiver positioned in the lower portion and in signal communication with a drilling tool, the upper and the lower transceivers in signal communication with one another via wireless induction telemetry wherein the upper transceiver includes an antenna positioned within a bore of a drill collar adjacent to a thinned wall section of the drill collar, wherein the thinned wall section of the drill collar comprises one of an increased inside diameter relative to a base inside diameter of the drill collar and a decreased outside diameter relative to a base outside diameter of the drill collar.

8. The system of claim 7, wherein the drilling tool includes at least one of a measurement sensor and a steering system.

9. A method of bridging a wired-communication gap in a bottom-hole assembly ("BHA") that separates an upper portion including a surface telemetry system and a bottom portion having a drilling tool, the method comprising the steps of:

providing an upper transceiver in signal communication with a surface telemetry system;

providing a lower transceiver in signal communication with the drilling tool; and communicating between the upper transceiver and the lower transceiver via wireless induction telemetry wherein the upper transceiver includes an antenna positioned within a bore of the upper portion adjacent to a thinned wall section in the upper portion wherein the thinned wall section comprises at least one of an increased diameter relative to a base inside diameter of the wall of the upper section and a decreased outside diameter relative to a base outside diameter of the wall of the upper section.

10. The method of claim 9, wherein the wired-communication gap includes a mud motor.

11. The method of claim 9, wherein the wireless induction telemetry is at a frequency in the range of approximately 500 Hz to 10 kHz.

* * * * *